US006094904A

United States Patent [19]

Goodrich et al.

[11] Patent Number: 6,094,904

[45] Date of Patent: Aug. 1, 2000

[54] FUEL INJECTOR WITH A REPLACEABLE SENSOR

[75] Inventors: Vernon A. Goodrich, South Glastonbury; George A. Lanati, Suffield; Dennis J. Sullivan, Vernon, all of Conn.

[73] Assignee: United Technologies Corporation, Hartford, Conn.

[21] Appl. No.: 09/162,833

[22] Filed: Sep. 29, 1998

Related U.S. Application Data

[63] Continuation-in-part of application No. 09/116,740, Jul. 16, 1998, abandoned.

[51] Int. Cl.[7] ..... F02C 7/00

[52] U.S. Cl. ..... 60/39.33; 60/740; 60/748

[58] Field of Search ..... 60/39.33, 734, 60/737, 740, 748; 431/75, 89

[56] References Cited

U.S. PATENT DOCUMENTS

| | | | |
|---|---|---|---|
| 3,078,672 | 2/1963 | Meurer | 60/748 |
| 3,592,061 | 7/1971 | Schwedland et al. | 73/343 R |
| 4,029,966 | 6/1977 | Baker et al. | 250/372 |
| 4,132,114 | 1/1979 | Shah et al. | 73/343 R |
| 4,668,162 | 5/1987 | Cederwall et al. | 415/115 |
| 4,778,538 | 10/1988 | Lyman | 136/230 |
| 4,934,137 | 6/1990 | MacKay | 60/39.33 |
| 4,948,264 | 8/1990 | Hook, Jr. | 374/144 |
| 5,185,996 | 2/1993 | Smith et al. | 60/39.02 |
| 5,301,061 | 4/1994 | Nakada et al. | 359/362 |
| 5,423,610 | 6/1995 | Stansfeld et al. | 374/179 |
| 5,628,565 | 5/1997 | Hagen et al. | 374/143 |
| 5,671,597 | 9/1997 | Butler et al. | 60/737 |
| 5,678,926 | 10/1997 | Stansfeld et al. | 374/208 |
| 5,706,643 | 1/1998 | Snyder et al. | 60/39.06 |
| 5,755,090 | 5/1998 | Hu | 60/39.091 |

FOREIGN PATENT DOCUMENTS

| | | |
|---|---|---|
| 0 816 760 A1 | 1/1998 | European Pat. Off. . |
| 0 849 531 A2 | 6/1998 | European Pat. Off. . |

*Primary Examiner*—Charles G. Freay
*Attorney, Agent, or Firm*—Kenneth C. Baran

[57] ABSTRACT

A premixing fuel injector for a turbine engine includes easily replaceable means for monitoring temperature or other conditions of interest in the interior of the injector. The fuel injector includes a guide conduit (70) that penetrates into the injector's interior and has an externally accessible opening (74) for receiving a sensor probe (88). The probe carries at least one sensor, such as a thermocouple junction (106), for monitoring temperature or other conditions inside the injector. In one embodiment, the guide conduit has a nonlinear shape and the probe shank (92) is sufficiently flexible to follow the contour of the conduit and sufficiently rigid to overcome any insertion resistance that the conduit might offer. The flexibility of the shank (92) may vary longitudinally to enhance insertability of the probe into the conduit. The probe is longitudinally oversized relative to the conduit so that when the probe is correctly installed, a sensor element positioned at the probe tip (93) contacts the closed, distal end (84) of the conduit to improve the sensor's responsiveness to changing conditions inside the injector. The probe shank may also buckle slightly and press against the internal sidewall of the conduit to prevent excessive shank vibration.

18 Claims, 4 Drawing Sheets

FUEL INJECTOR WITH A REPLACEABLE SENSOR

This application is a continuation in part of U.S. application Ser. No. 09/116,740 filed Jul. 16, 1998. now abandoned.

TECHNICAL FIELD

This invention relates to fuel injectors for turbine engines, and particularly to a premixing fuel injector that includes an easily replaceable sensor for monitoring conditions in the interior of the injector.

BACKGROUND OF THE INVENTION

Combustion of fossil fuel in a gas turbine engine produces a number of objectionable combustion byproducts including nitrous oxides (NOx). Regulatory authorities often impose stringent limits on turbine engine NOx emissions, especially when those emissions are produced by stationary, ground based engines used as industrial powerplants. Accordingly, turbine engine manufacturers continually seek improved ways to inhibit NOx formation.

One of the principal NOx suppression strategies is to burn a stoichiometrically lean, thoroughly blended fuel-air mixture. Typically, fuel and air are aggressively blended together in an internal mixing chamber of a premixing fuel injector before being introduced into the engine combustion chamber and burned. The lean, thoroughly blended fuel-air mixture results in a uniformly low combustion flame temperature—a prerequisite for NOx suppression.

Although fuel injectors that premix fuel and air are effective at producing the requisite, intimately blended fuel-air mixture, they suffer from certain shortcomings. For example, the presence of the fuel-air mixture inside the injector can encourage the combustion flame to migrate into the mixing chamber where the flame can cause considerable damage. Accordingly, premixing fuel injectors have a number of physical features designed to resist flame ingestion and to quickly disgorge any flame that overcomes the ingestion resistance. Despite these features, a flame can occasionally become anchored inside the mixing chamber. Therefore a premixing injector may also have one or more temperature sensors to detect the presence of flame so that appropriate corrective action can be taken. In one existing arrangement, the temperature sensor is a thermocouple welded to the interior of the injector with its sensing junction positioned near the mixing chamber.

Although the welded thermocouple is effective for monitoring internal temperature, it is not easily replaceable. If the thermocouple malfunctions, maintenance technicians must first remove the affected fuel injector from the engine. The fuel injector is then disassembled, the weld joints are broken to release the inoperative thermocouple, and a replacement thermocouple is welded into position. Finally, the injector is reassembled and reinstalled in the engine. Clearly, this procedure is unacceptably time consuming and labor intensive. Moreover, industrial operations are disrupted and operating revenue is sacrificed while the engine is out of service. An engine operator may keep one or more spare injectors on hand to minimize the length of service disruptions. However, this option is unappealing because of the expense of acquiring and stockpiling spare injectors.

What is needed is a premixing fuel injector having conveniently replaceable means for internal temperature monitoring.

SUMMARY OF THE INVENTION

According to the invention a premixing fuel injector for a turbine engine includes an elongated guide conduit that penetrates into the injector's interior and has an externally accessible opening for receiving a probe with at least one sensor for sensing conditions at a prescribed location within the injector.

According to one aspect of the invention the guide conduit has a nonlinear shape, and the probe is deformable so that it conforms readily to the nonlinear shape, thereby facilitating insertion of the probe into the conduit. According to a related aspect of the invention, the probe is also sufficiently rigid to overcome any insertion resistance offered by the conduit. Thus, the injector is suitable for engines in which straight line access between the externally accessible conduit opening and the prescribed location of the sensor is impractical or unrealizable.

According to another aspect of the invention, the end of the conduit remote from the opening is closed, and the sensor element resides at the tip of the probe. The probe is longitudinally oversized relative to the conduit so that when the probe is correctly installed, the sensor contacts the closed end of the conduit to maximize the sensor's transient responsiveness.

According to yet another aspect of the invention the probe can be installed or removed without appreciable twisting or rotation of the probe relative to the conduit, thereby minimizing the potential for damaging the probe during installation or removal.

The foregoing aspects, features and advantages and the operation of the invention will become more apparent in light of the following description of the best mode for carrying out the invention and the accompanying drawings.

BEST MODE FOR CARRYING OUT THE INVENTION

Figure 1:
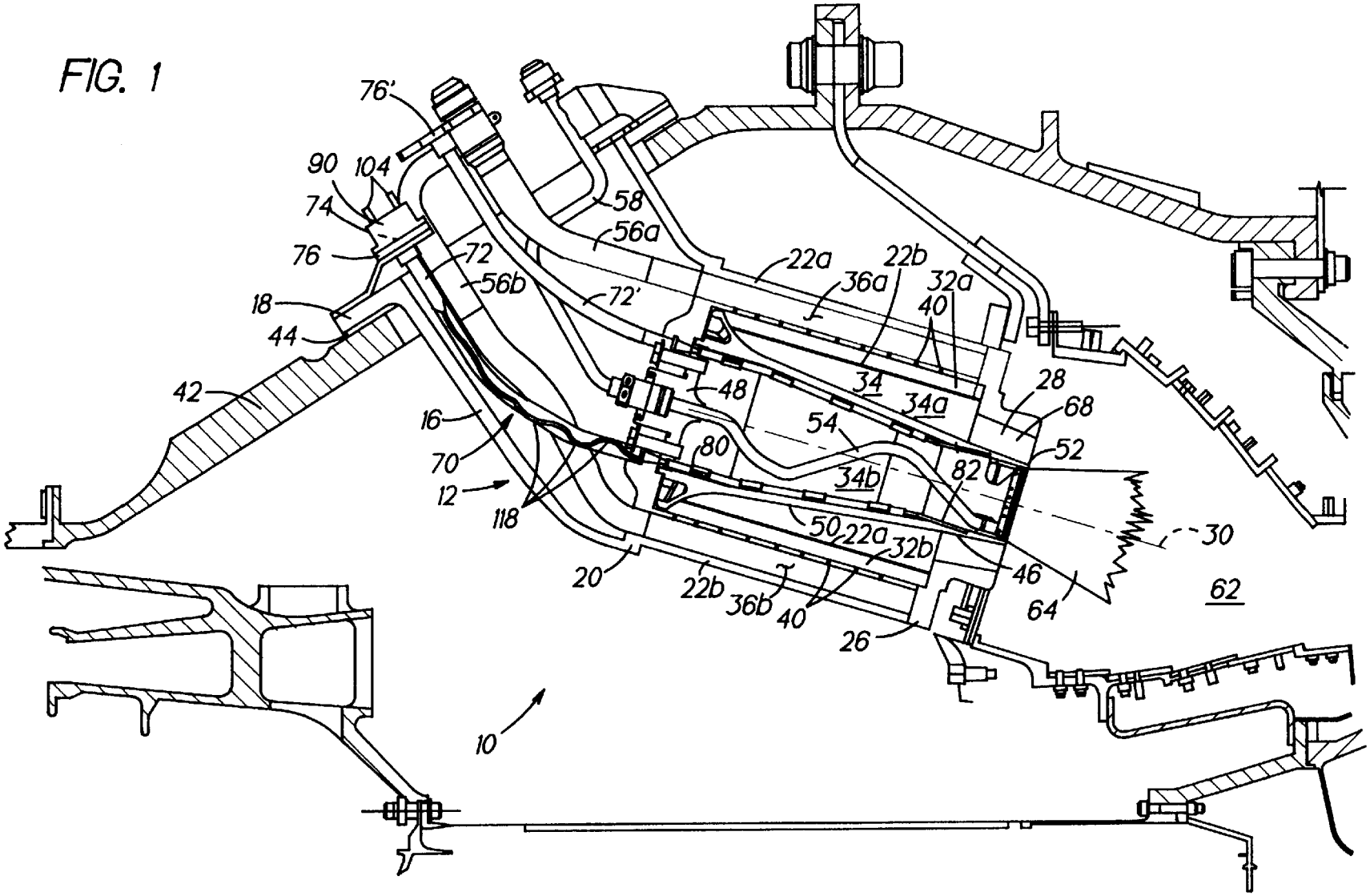
FIG. 1 is a schematic, cross sectional side elevation showing a premixing fuel injector installed in the combustor module of an industrial gas turbine engine.
Figure 2:
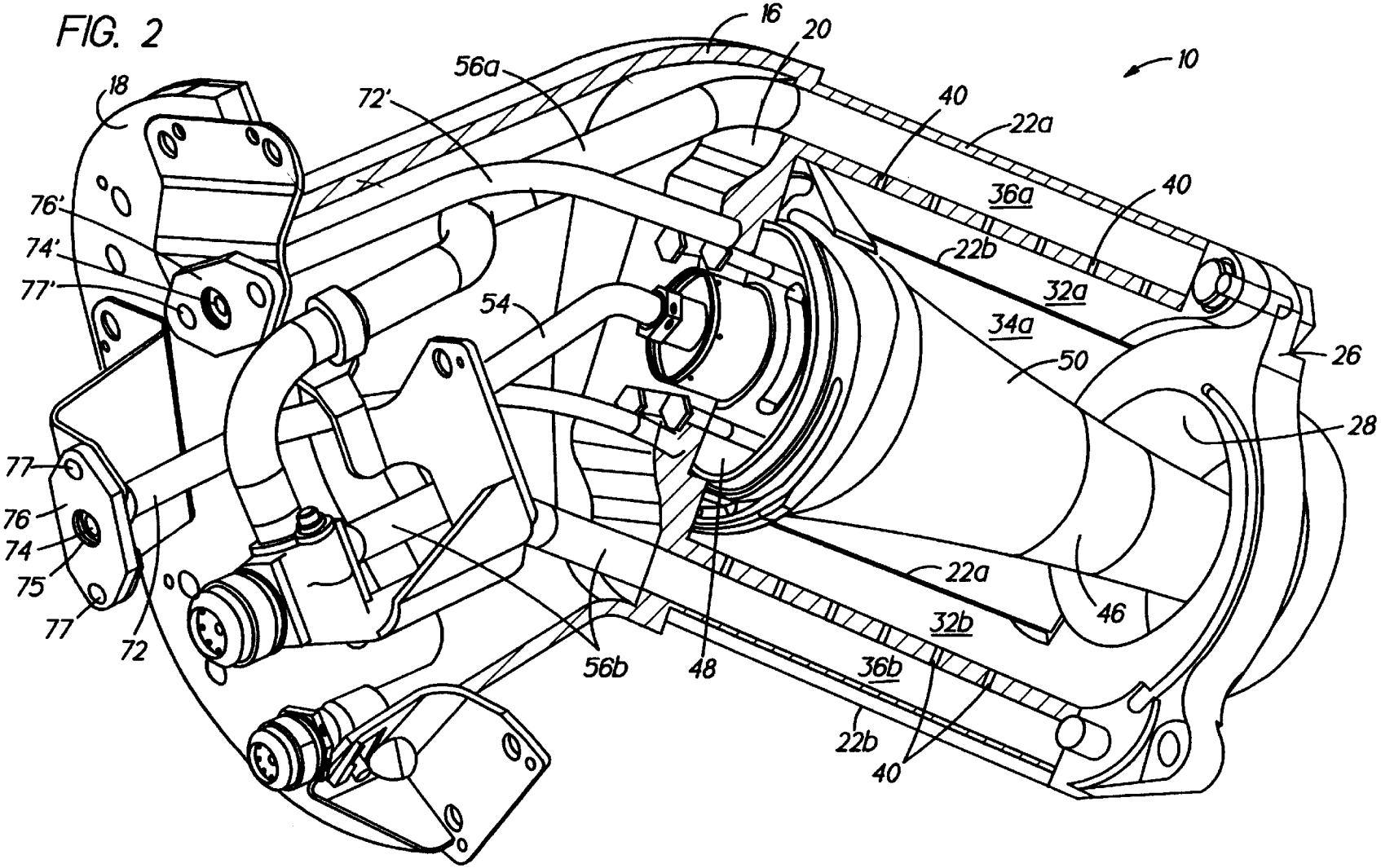
FIG. 2 is a more detailed, perspective view of the premixing fuel injector of FIG. 1 partially cut away to expose the interior of the injector.
Figure 3:
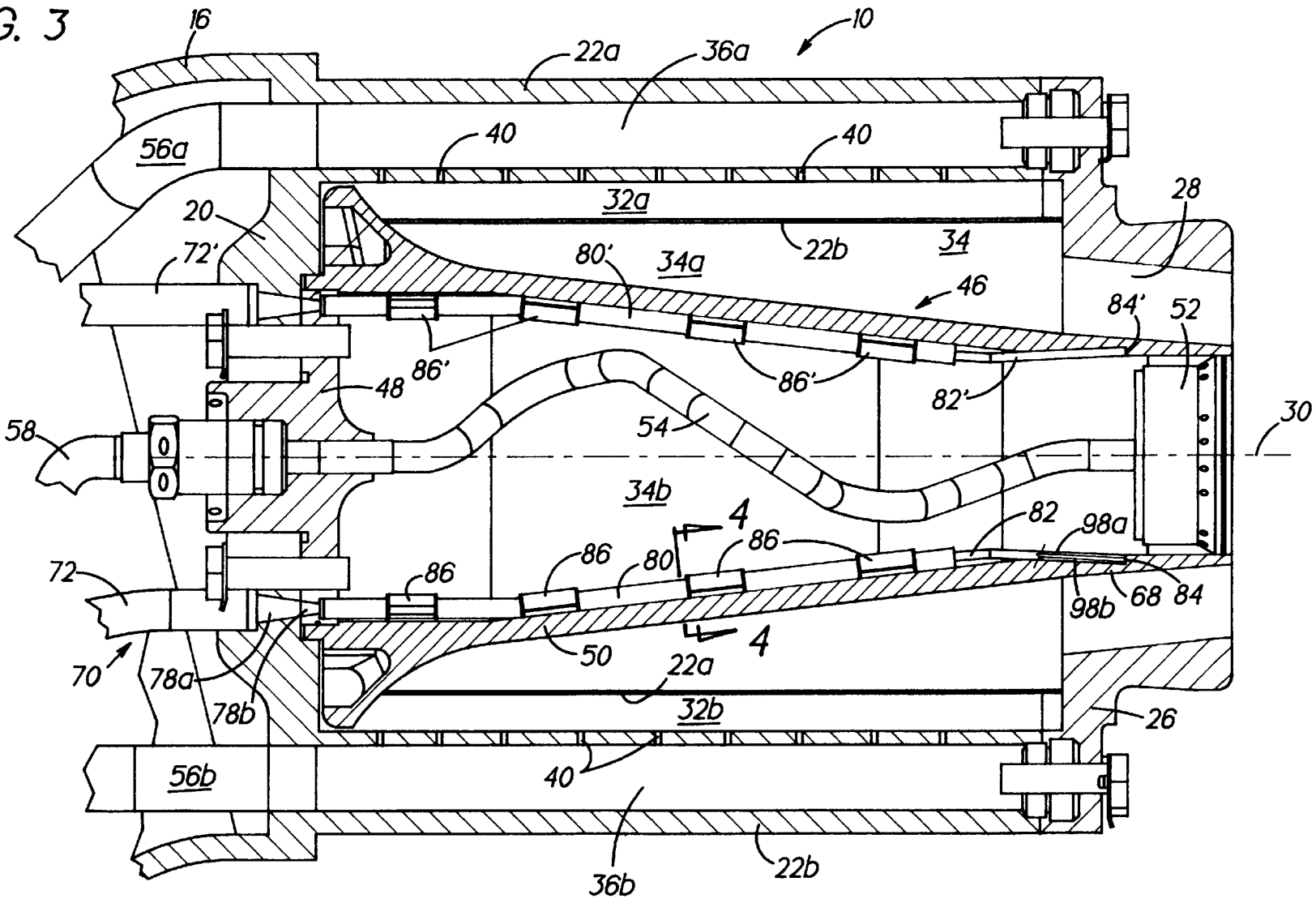
FIG. 3 is a more detailed, cross sectional side elevation of the fuel injector of FIG. 1.

FIGS. 1–3 illustrate a premixing fuel injector 10 for an industrial gas turbine engine. The injector, which is one of a plurality of injectors used in the engine, includes a frame 12 having a support 16 that extends from a mounting flange 18 to a forward bulkhead 20. A pair of arcuate scrolls 22*a*, 22*b* project longitudinally from the forward bulkhead to an aft bulkhead 26 and have a fuel-air discharge port 28 extending therethrough. Each scroll extends approximately 180° about fuel injector centerline 30, and is radially offset from the centerline so that the circumferential extremities of the scrolls cooperate to define a pair of longitudinally extending primary air intake slots 32*a*, 32*b*. The scrolls also define the radially outer boundary of an internal chamber 34. Each scroll includes an enlarged portion that accommodates a primary fuel supply manifold 36*a*, 36*b* and an array of primary fuel injection orifices 40 distributed along the length of the manifold. When installed in an engine, the mounting flange 18 is bolted to a fuel injector support engine case 42 with an airtight gasket 44 compressed between the mounting flange 18 and the case 42.

The injector 10 also includes a centerbody 46 embraced by and radially spaced from the scrolls. The centerbody includes a base 48 secured to the forward bulkhead 20, a shell 50 extending longitudinally from the base, a fuel-air injection insert 52 nested within the aft end of the shell and a secondary fuel supply tube 54 connecting the insert to a fuel passage in the centerbody base 48. The centerbody shell segregates internal chamber 34 into an annular main chamber 34*a*, radially bounded by the shell and the scrolls, and a subchamber 34*b*. The main chamber is a mixing chamber for intermixing primary air and primary fuel. The subchamber is a secondary air supply plenum for feeding secondary air to the insert 52.

Dual primary fuel lines 56*a*, 56*b* and secondary fuel line 58 are connected to a fuel supply, not shown, and penetrate through the support flange 18 to supply fuel to the fuel manifolds 36*a*, 36*b* and the secondary fuel tube 54.

During operation, primary air enters the mixing chamber tangentially through intake slots 32*a*, 32*b* while primary fuel is introduced into the incoming airstream through injection orifices 40. The primary fuel and air enter the mixing chamber 34*a*, swirl around the centerbody 46 and become intimately intermixed. The fuel-air mixture flows longitudinally and enters the engine combustor 62 where the mixture is ignited and burned in a combustion flame 64. Concurrently, secondary fuel and secondary air are introduced into the combustor through the secondary fuel-air insert 52. Further description of the features and operation of the above described premixing fuel injector can be found in commonly owned copending U.S. patent applications Ser. No. 08/991,032 entitled "Bluff Body Premixing Fuel Injector and Method for Premixing Fuel and Air", filed on Dec. 15, 1997; Ser. No. 09/046,903 entitled "Improved Durability Flame Stabilizing Fuel Injector" filed on Mar. 24, 1998; Ser. No. 09/080,485 entitled "Premixing Fuel Injector and Method of Operation" filed on May 18, 1998; and Ser. No. 09/093,371 entitled "Premixing Fuel Injector with Improved Secondary Fuel-Air Injection", filed on Jun. 8, 1998.

The above described injector is effective at thoroughly premixing the primary fuel and air, and therefore promotes clean combustion and inhibits NOx formation. However the presence of the thoroughly blended fuel-air mixture inside the mixing chamber 34*a* can encourage the flame 64 to migrate into the chamber where, if not quickly disgorged or extinguished, it can cause considerable damage. One method for extinguishing the flame includes monitoring the temperature inside the mixing chamber and, if the temperature suggests that a flame is present, temporarily interrupting the fuel supply to the injector.

Figure 4B:
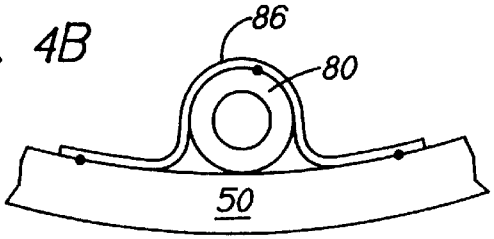
FIG. 4A and 4B are views in the direction 4—4 of FIG. 3 showing a portion of a guide conduit for a sensor probe and a clamp for securing the conduit to the interior of the injector.
Figure 4A:
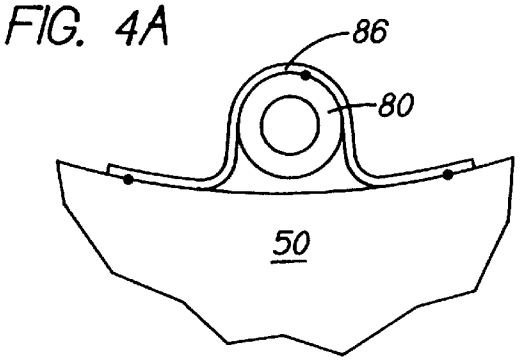

The illustrated injector includes means for monitoring temperature at a prescribed location 68 near the aft end of the mixing chamber, and specifically within the fuel-air discharge port 28. The temperature monitoring means includes a substantially longitudinally continuous guide conduit indicated generally at 70. The conduit includes a proximate tube 72 with an access opening 74 having a metallic seal ring 75 installed therein. The access opening is circumscribed by a mounting pad 76 that includes a pair of bolt receptacles 77. The access opening is accessible externally of the injector and, when the injector is mounted on case 42, externally of the case 42 as well. The proximate tube extends from the access opening to a pair of tapered passages 78*a*, 78*b* (FIG. 3) arranged in series and penetrating respectively through the bulkhead 20 and centerbody base 48. An intermediate tube 80 (FIGS. 1 and 3) having a diameter smaller than that of the proximate tube originates at the passage 78*b* and extends along the interior of the centerbody shell. As seen best in FIGS. 3, 4A and 4B, a set of saddle clamps 86 are brazed to the intermediate tube and to the inside surface of the centerbody shell to secure the tube to the shell. A distal tube 82 having a diameter smaller than that of the intermediate tube projects from the intermediate tube to the prescribed location 68 and is brazed to the inside surface of the centerbody shell. The distal end 84 of the conduit 70, which is the remote end of the distal tube 82, is closed. Physical constraints such as the nonperpendicular orientation of case 42 relative to the injector centerline, and the conical shape of the centerbody shell, prohibit straight line access from the access opening 74 to the prescribed location 68. Accordingly the conduit extends nonlinearly from the access opening 74 to the closed, distal end 84.

Figure 7:
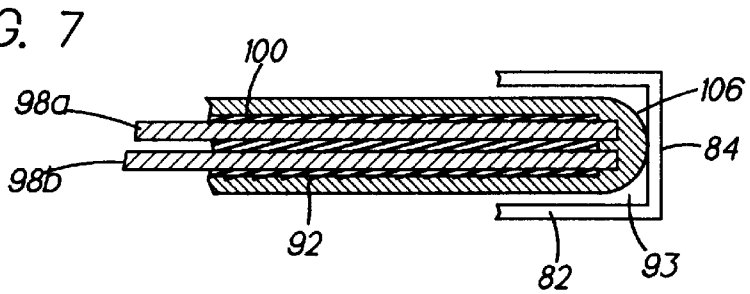
FIG. 7 is an enlarged view of the tip end of the sensor probe of FIG. 5 showing the thermocouple leads and a thermocouple junction.
Figure 5:
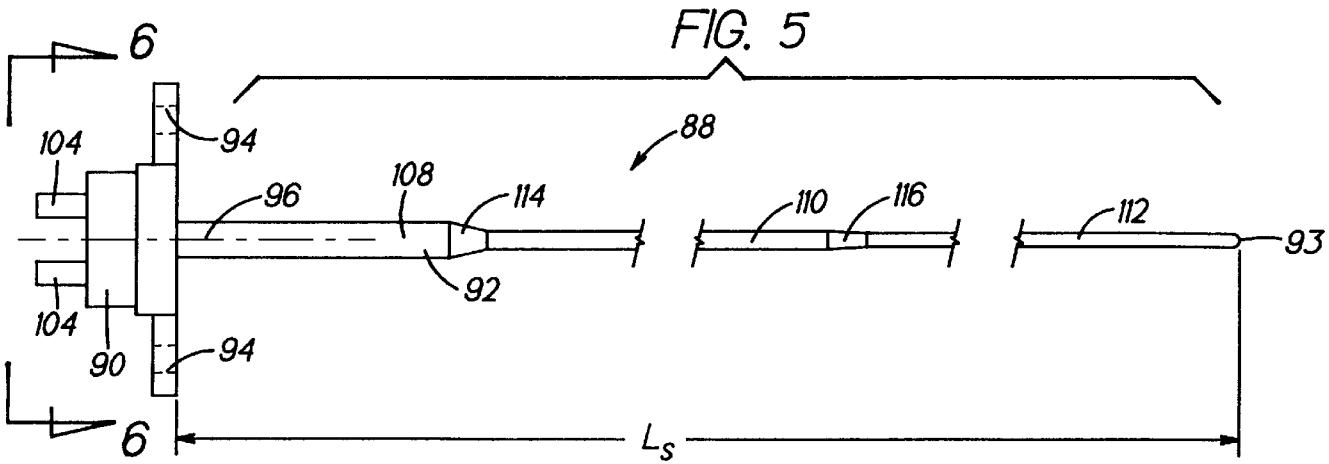
FIG. 5 is a side view of a sensor probe having a thermocouple junction at its tip end.
Figure 6:
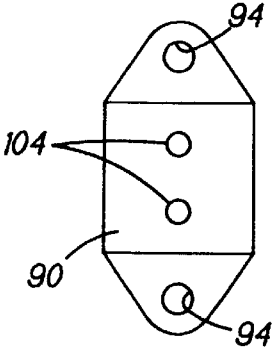
FIG. 6 is an end view of the sensor probe taken in the direction 6—6 of FIG. 5.

The temperature monitoring means also includes an insertable probe, exemplified by sensor probe 88, removably installed in the guide conduit. As seen in FIGS. 5, 6 and 7, the sensor probe has a base 90 and a single piece swaged shank 92 that extends from the base to a tip end 93. Bolt holes 94 extend through the base so that the sensor probe may be removably secured to mounting pad 76. If desired, the bolt holes may be spaced unequally from the probe centerline 96, and the corresponding bolt receptacles 77 may be correspondingly spaced from the center of the access opening 74 to ensure that the probe is secured in a preferred, predesignated orientation.

The probe shank 92 encapsulates a pair of thermocouple leads 98*a*, 98*b* separated from the shank and from each other by electrically nonconductive refractory insulation 100. The leads are individually connected to electrical terminals 104 projecting from the probe base. At the tip end 93 of the shank the leads join together to form a thermocouple sensing junction 106.

The shank itself is at least elastically deformable so that it readily conforms to the nonlinear shape of the guide conduit when inserted longitudinally therein through access opening 74. The shank of the illustrated probe is both elastically deformable and plastically deformable. That is, once the probe has been inserted into and subsequently removed from the guide conduit, the shank springs back toward its original shape, but also exhibits a permanent set due to the nonlinear shape of the guide conduit. However the shank is also rigid enough to overcome any insertion resistance that the conduit might offer. In the illustrated embodiment, probe insertability and conformability are enhanced by a shank having longitudinally varying flexibility. As seen in FIG. 5, the shank has a proximate segment 108, an intermediate segment 110 and a distal segment 112 with short transition segments 114, 116 linking the intermediate segment to the proximate and distal segments. The proximate, intermediate and distal segments are each characterized by a different cross sectional area and hence by a different degree of flexibility so that the flexibility of the shank varies in an approximately stepwise manner. Near the probe base, rigidity is desirable for enhancing insertability.

Accordingly, the cross sectional area of shank segment 108 is relatively large a nd the shank is relatively rigid. Near the tip, flexibility is desirable for ensuring that the shank can follow the contour of the guide conduit. Thus, the cross sectional area of shank segment 112 is relatively small and the shank is relatively flexible. If desired, the shank could be made with a continuously varying cross sectional area to give the probe a continuously varying flexibility.

When the probe is correctly installed in the guide conduit (FIG. 1), the probe base 90 seats against the mounting pad 76 and is bolted thereto by bolts, not illustrate d. Preferably, the probe shank is longitudinally oversized relative to the length of the guide conduit so that the thermocouple junction 106 at the tip 93 of the probe is urged into contact with the closed, distal end 84 of the conduit (FIG. 7). In addition, and as seen best in FIG. 1, the probe shank 92 buckles slightly so that the shank presses against the internal sidewall of the conduit at one or more contact points 118. The contact between the thermocouple junction 106 and the distal end 84 of the conduit enhances the junction's responsiveness to temperature changes inside the injector mixing chamber 34*a*. Contact between the shank and the conduit sidewall braces the shank to prevent excessive shank vibration. In the illustrated arrangement, the conduit length $L_c$ is about 17.75 inches (45.1 cm.) and the shank length $L_s$ is about 0.1 inches (0.25 cm.) longer than the conduit length. In the illustrated injector, a second temperature sensing system, substantially similar to the one just described and indicated with primed reference characters, is included to assure reliable flame detection.

As can be best appreciated from FIG. 1, replacement of the sensor probe can be accomplished without removing the injector from the engine, and without disassembling the injector. Instead, removal of the sensor probe is accomplished by merely unbolting the probe base 90 from the mounting pad 76 and sliding the probe longitudinally out of the guide conduit. Probe installation is accomplished by sliding the probe shank longitudinally into the conduit and reconnecting the probe base to the mounting pad. Neither installation nor removal of the probe requires any appreciable rotation or twisting of the probe relative to the guide conduit. Accordingly, the risk of damage to the probe or to the sensor element 106 is minimized.

The illustrated probe could carry multiple sensor elements rather than a single sensor element positioned at the probe tip 93. Moreover, the sensor element or elements need not be thermocouple sensing junctions, but may instead be any sensor element capable of responding to conditions of interest inside the injector. These and other changes, modifications and adaptations may be made without departing from the invention as set forth in the accompanying claims.

We claim:

1. A premixing fuel injector, comprising:

an injector frame at least part of which bounds an internal chamber;

a guide conduit having a proximate end with an access opening accessible externally of the injector for receiving an insertable probe, and a distal end positioned internally of the injector; and a sensor probe removably installed in the guide conduit and having a base end, a tip end and at least one sensor element for sensing conditions within the injector.

2. The fuel injector of claim 1 wherein the guide conduit has a nonlinear shape and the sensor probe is deformable to conform to the nonlinear shape.

3. The fuel injector of claim 1 wherein the sensor probe is sufficiently rigid to overcome resistance to longitudinal insertion of the probe into the guide conduit.

4. The fuel injector of claim 2 wherein the sensor probe is sufficiently rigid to overcome resistance to longitudinal insertion of the probe into the guide conduit.

5. The fuel injector of claim 2 wherein the sensor probe has a longitudinally varying flexibility that increases from the base end to the tip end thereby making the probe deformable enough to conform to the nonlinear shape of the guide conduit and rigid enough to overcome resistance to longitudinal insertion of the probe into the guide conduit.

6. The fuel injector of claim 5 wherein the longitudinally varying flexibility of the sensor probe varies in an approximately stepwise manner.

7. The fuel injector of claim 6 wherein the stepwise flexibility is attributable to approximately stepwise variation of the sensor probe cross sectional area.

8. The fuel injector of claim 1 wherein the distal end of the conduit is closed, the sensor element is at the tip end of the sensor probe and the probe is longitudinally oversized relative to the guide conduit so that when the probe is correctly installed in the guide conduit the sensor element is urged into contact with the closed, distal end of the guide conduit.

9. The fuel injector of claim 8 wherein the sensor probe is longitudinally oversized so that when the probe is correctly installed in the guide conduit the probe is urged into contact with the sidewall of the conduit.

10. The fuel injector of claim 1 wherein the sensor probe is installable in and removable from the guide conduit by longitudinally translating the probe relative to the conduit without appreciable rotation or twisting of the probe relative to the conduit.

11. The fuel injector of claim 1 wherein the sensor element is a temperature sensing element and the sensed condition is temperature.

12. The fuel injector of claim 11 wherein the temperature sensing element is a thermocouple sensing junction.

13. The fuel injector of claim 1 wherein the internal chamber includes a main chamber and a subchamber and the guide conduit extends into the subchamber.

14. The fuel injector of claim 1 including means for mounting the injector on an engine case so that the access opening is accessible externally of the engine case.

15. A premixing fuel injector for a turbine engine, comprising:

an injector frame including an injector support and a pair of arcuate, radially offset scrolls extending from the support;

a centerbody circumscribed by and radially spaced from the scrolls, the centerbody cooperating with the scrolls to define an annular mixing chamber, the centerbody also defining the radially outer extremity of a secondary air supply plenum;

a guide conduit extending into the plenum, the guide conduit having a proximate end with an access opening accessible externally of the injector for receiving an insertable probe, and a distal end positioned internally of the injector; and a sensor probe removably installed in the guide conduit and having a base end, a tip end and at least one sensor element for sensing conditions within the mixing chamber.

16. The fuel injector of claim 15, wherein the conduit has a nonlinear shape and the sensor probe is sufficiently deformable to conform to the nonlinear shape and sufficiently rigid to overcome resistance to longitudinal insertion of the probe into the guide conduit.

17. The fuel injector of claim 16 wherein the distal end of the guide conduit is closed, the sensor element is at the tip end of the sensor probe and the probe is longitudinally oversized relative to the guide conduit so that when the probe is correctly installed in the guide conduit the sensor element is urged into contact with the closed, distal end of the guide conduit.

18. The fuel injector of claim 17 wherein the sensor probe is longitudinally oversized so that when the probe is correctly installed in the guide conduit the probe is urged into contact with the sidewall of the conduit.

* * * * *